US006725010B1

(12) United States Patent
Parker

(10) Patent No.: US 6,725,010 B1
(45) Date of Patent: Apr. 20, 2004

(54) FUSING APPARATUS HAVING AN INDUCTION HEATED FUSER ROLLER

(75) Inventor: Delmer G. Parker, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 505 days.

(21) Appl. No.: 09/307,445

(22) Filed: May 10, 1999

(51) Int. Cl.[7] ..... G03G 15/20
(52) U.S. Cl. ..... 399/330; 219/216
(58) Field of Search ..... 399/328, 330; 219/216, 600, 601, 619, 645

(56) References Cited

U.S. PATENT DOCUMENTS

| | | | | |
|---|---|---|---|---|
| 4,570,044 A | | 2/1986 | Kobayashi et al. | 219/10.49 A |
| 5,911,094 A | * | 6/1999 | Tsujimoto | 399/69 |
| 6,021,303 A | * | 2/2000 | Terada et al. | 399/328 |

FOREIGN PATENT DOCUMENTS

| | | |
|---|---|---|
| JP | 57-205767 | * 12/1982 |
| JP | 58-035568 | * 3/1983 |
| JP | 10-207278 | * 8/1998 |

* cited by examiner

*Primary Examiner*—Robert Beatty
(74) *Attorney, Agent, or Firm*—Tallam I. Nguti

(57) ABSTRACT

A fusing apparatus for heating and permanently fusing toner powder images onto an image carrying sheet. The fusing apparatus includes a pressure roller; a closed loop magnetic flux carrying member positioned adjacent the pressure roller and including a first side and a second side opposite the first side. The first side is located between the pressure roller and the second side. The fusing apparatus also includes an electrically conductive wire wound about the second side forming a primary transformer coil having N1 number of turns. The primary transformer coil is connectable to an AC power supply source for inductively transferring AC electric energy to the first side. Importantly, the fusing apparatus includes a rotatable fuser roller forming a fusing nip with the pressure roller. The rotatable fuser roller has an electrically conductive layer and a rigid non-conductive core in the form of a ceramic tube underlying the conductive layer. The rotatable fuser roller is mounted around the first side of the closed loop magnetic flux carrying member and forms a secondary transformer coil inductively coupled to the primary transformer coil, and the conductive layer is inductively heated by power dissipated by current induced therein when the primary transformer coil is connected to the AC power supply source.

5 Claims, 3 Drawing Sheets

FUSING APPARATUS HAVING AN INDUCTION HEATED FUSER ROLLER

RELATED APPLICATIONS

This application is related to U.S. application Ser. No. 09/307,842, now U.S. Pat. No. 6,122,477 entitled "INDUCTION HEATED FUSING APPARATUS HAVING A DUAL FUNCTION TRANSFORMER ASSEMBLY" filed on even date herewith, and having at least one common inventor.

BACKGROUND OF THE INVENTION

This invention relates to fusing toner images and more particularly to a heat and pressure roller fuser for fixing toner images to copy substrates.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

After the electrostatic latent image is recorded on the photoconductive surface, it is developed by bringing a developer material including toner particles into contact therewith to thereby form toner images on the photoconductive surface. The images are generally transferred to a support surface such as plain paper to which they may be permanently affixed by heating or by the application of pressure or a combination of both.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roller to thereby effect heating of the toner images within the nip. As will be appreciated, in a machine where duplex images are created both rolls may be heated. In either case, one of the rolls is usually referred to as the fuser roller while the other is commonly referred to as a pressure or back-up roll.

U.S. Pat. No. 4,570,044 discloses a basic induction heated roller fusing system as above. Unfortunately, in induction heated apparatus as such, the thermal time constant of the inductively heated fuser roll is hard to minimize, and mechanical support elements such as end caps, bearings, gears, and yokes that enclose the transformer core are undesirably heated extraneously.

SUMMARY OF THE INVENTION

In accordance with the present invention, there is provided a fusing apparatus for heating and permanently fusing toner powder images onto an image carrying sheet. The fusing apparatus includes a pressure roller; a closed loop magnetic flux carrying member positioned adjacent the pressure roller and including a first side and a second side opposite the first side. The first side is located between the pressure roller and the second side. The fusing apparatus also includes an electrically conductive wire wound about the second side forming a primary transformer coil having N1 number of turns. The primary transformer coil is connectable to an AC power supply source for inductively transferring AC electric energy to the first side. Importantly, the fusing apparatus includes a rotatable fuser roller forming a fusing nip with the pressure roller. The rotatable fuser roller has an electrically conductive layer and a rigid non-conductive core in the form of a ceramic tube underlying the conductive layer. The rotatable fuser roller is mounted around the first side of the closed loop magnetic flux carrying member and forms a secondary transformer coil inductively coupled to the primary transformer coil, and the conductive layer is inductively heated by power dissipated by current induced therein when the primary transformer coil is connected to the AC power supply source.

BRIEF DESCRIPTION OF THE DRAWINGS

In the detailed description of the invention presented below, reference is made to the drawings, in which.

DETAILED DESCRIPTION OF THE INVENTION

Figure 1:
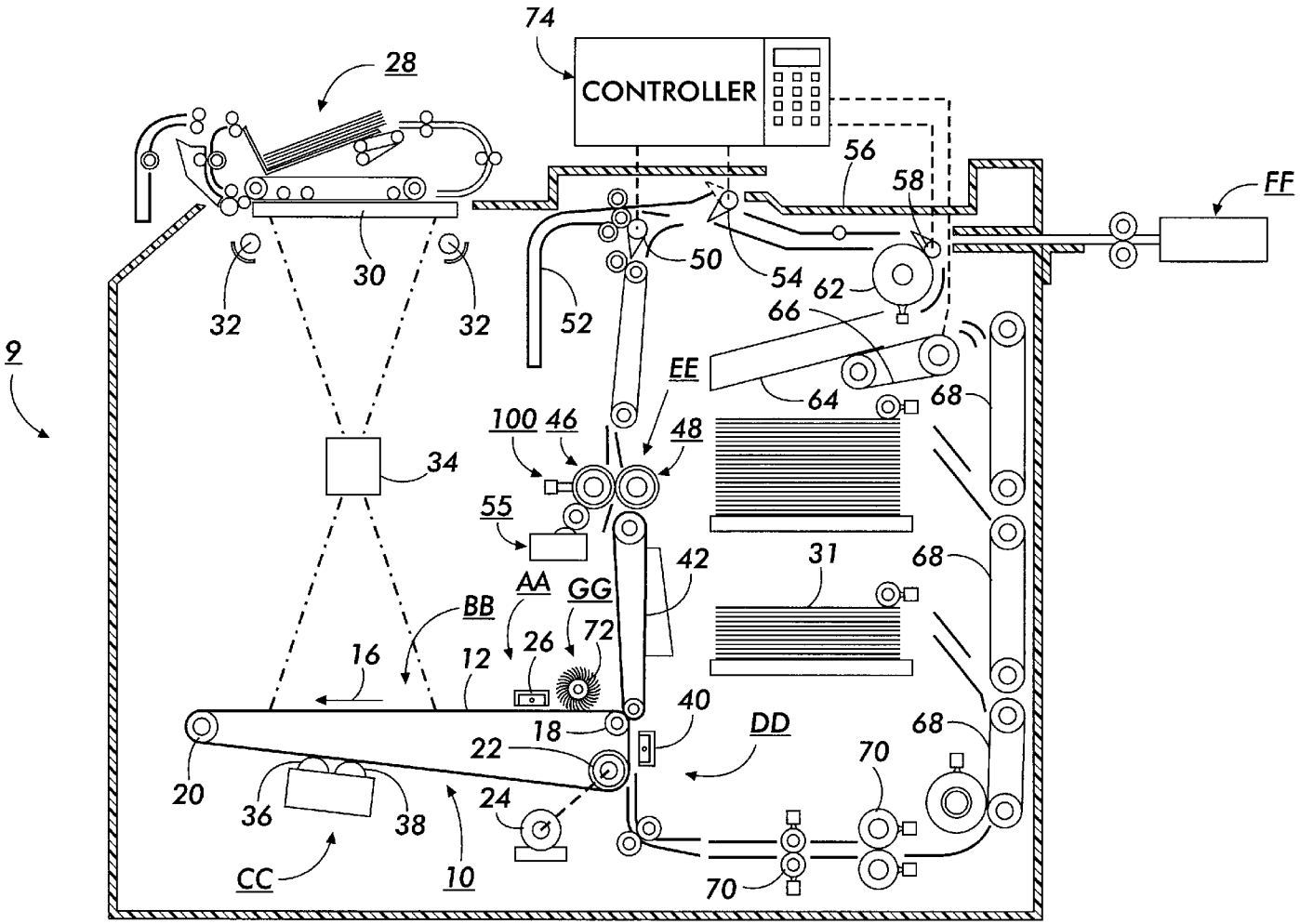
FIG. 1 is a schematic illustration of an electrostatographic reproduction machine including an induction heated fusing apparatus of the present invention.

For a general understanding of the features of the present invention, reference is made to the drawings. In the drawings, like reference numerals have been used throughout to identify identical elements. FIG. 1 schematically depicts an electrophotographic printing machine 9 incorporating the features of the present invention therein.

Referring to FIG. 1 of the drawings, the electrophotographic printing machine 9 employs a photoconductive member such as a belt 10 having a photoconductive surface 12 deposited on a conductive substrate (not shown). Belt 10 moves in the direction of arrow 16 to advance successive portions of photoconductive surface 12 sequentially through various electrostatographic processing stations disposed about a path of movement thereof. As shown, belt 10 is entrained about stripping roller 18, tensioning roller 20, and drive roller 22. Stripping roller 18 is mounted rotatably so as to rotate with belt 10. Tensioning roller 20 is resiliently urged against belt 10 to maintain belt 10 under the desired tension. Drive roller 22 is rotated by motor 24 coupled thereto by suitable means such as a belt drive. As roller 22 rotates, it advances belt 10 in the direction of arrow 16.

Initially, a portion of the photoconductive belt 10 passes through a charging station AA. At charging station AA, a corona generating device, indicated generally by the reference numeral 26, charges photoconductive surface 12 of belt 10 to a relatively high, and substantially uniform potential.

Next, the charged portion of photoconductive surface 12 is advanced through an imaging station BB. At imaging station BB, a document handling unit, indicated generally by the reference numeral 28, is positioned over a platen 30 of the printing machine. Document handling unit 28 sequentially feeds documents from a stack of documents placed by an operator, for example, face up in a normal forward collated order in a document stacking and holding tray. A document feeder located below the tray forwards the bottom document in the stack to a pair of takeaway rollers. The belt advances the document to platen 30. After imaging, the original document is fed from platen 30 by the belt into a guide and feed roller pair. The document then advances into an inverter mechanism and back to the document stack through the feed roller pair. A position gate is provided to divert the document to the inverter or to the feed roller pair.

Imaging of a document is achieved, for example, using lamps 32 which illuminate the document on platen 30. Light rays reflected from the document are transmitted through lens 34. Lens 34 focuses light images of the original document onto a uniformly charged portion of photoconductive surface 12 of belt 10 to selectively dissipate the charge thereon. This records an electrostatic latent image on photoconductive surface 12 which corresponds to the informational area contained within the original document.

Obviously, electronic imaging of page image information could be facilitated by a electrostatographic reproduction machine utilizing electrical imaging signals. The electrostatographic reproduction machine can be a digital copier including an input device such as a Raster Input Scanner (RIS) and a printer output device such as a Raster Output Scanner (ROS), or, a printer utilizing only a printer output device such as a ROS.

Thereafter, belt 10 advances the electrostatic latent image recorded on photoconductive surface 12 to a development station CC. At development station CC, a pair of magnetic brush developer rolls indicated generally by the reference numerals 36 and 38, advance developer material into contact with the electrostatic latent image. The latent image attracts toner particles from the carrier granules of the developer material to form a toner powder image on photoconductive surface 12 of belt 10. Belt 10 then advances the toner powder image to transfer station DD.

At transfer station DD, a copy sheet is moved into contact with the toner powder image. Transfer station DD includes a corona generating device 40 which sprays ions onto the backside of the copy sheet. This attracts the toner powder image from photoconductive surface 12. After transfer, a conveyor 42 advances the copy sheet to a fusing station EE of the present invention.

Generally, fusing station EE includes a fuser assembly, indicated generally by the reference numeral 100, which heats and permanently affixes the transferred toner powder image to the copy sheet. As further shown, fuser assembly 100 includes a heated fuser roller 46 and a back-up or pressure roller 48 with the powder image on the copy sheet contacting fuser roller 46. The pressure roller 48 is cammed against the fuser roller 46 to provide necessary pressure for fixing the toner powder image to the copy sheet.

After fusing, copy sheets of the fused images are fed to gate 50 which functions, as an inverter selector. Depending upon the position of gate 50, the copy sheets are deflected to sheet inverter 52 or bypass inverter 52 and are fed directly to a second decision gate 54. At gate 54, the sheet is in a face up orientation with the image side, which has been fused, face up. If inverter path 52 is selected, the opposite is true, i.e. the last printed side is facedown. Decision gate 54 either deflects the sheet directly into an output tray 56 or deflects the sheet to decision gate 58. Decision gate 58 may divert successive copy sheets to duplex inverter roller 62, or onto a transport path to finishing station FF.

At finishing station FF, copy sheets are stacked in a compiler tray and attached to one another to form sets. The sheets are attached to one another by either a binding device or a stapling device. In either case, a plurality of sets of documents are formed in finishing station FF. When decision gate 58 diverts the sheet onto inverter roller 62, roller 62 inverts and stacks the sheets to be duplexed in duplex tray 64. Duplex tray 64 provides an intermediate or buffer storage for those sheets that have been printed on one side and on which an image will be subsequently printed on the second, opposed side thereof, i.e. the sheets being duplexed. The sheets are stacked in duplex tray facedown on top of one another in the order in which they are copied.

In order to complete duplex copying, the simplex sheets in tray 64 are fed seriatim, by bottom feeder 66 from tray 64 back to transfer station DD via conveyors 68 and rollers 70 for transfer of the toner powder image to the opposed sides of the copy sheets. In as much as successive bottom sheets are fed from 20 duplex tray 64, the proper or clean side of the copy sheet is positioned in contact with belt 10 at transfer station DD so that the toner powder image is transferred thereto. The duplex sheet is then fed through the same path as the simplex sheet to be stacked in tray 56 or, when the finishing operation is selected, to be advanced to finishing station FF.

Invariably, after the copy sheet is separated from photoconductive surface 12 of belt 10, some residual particles remain adhering thereto. These residual particles are removed from photoconductive surface 12 at cleaning station GG. Cleaning station GG includes a rotatably mounted fibrous or electrostatic brush 72 in contact with photoconductive surface 12 of belt 10. The particles are removed from photoconductive surface 12 of belt 10 by the rotation of brush 72 in contact therewith. Subsequent to cleaning, a discharge lamp (not shown) floods photoconductive surface 12 to dissipate any residual electrostatic charge remaining thereon prior to the charging thereof for the next successive imaging cycle.

The various machine functions are regulated by a controller 74. Controller 74 is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. In addition, controller 74 regulates the various positions of the decision gates depending upon the mode of operation selected. Thus, when the operator selects the finishing mode, either an adhesive binding apparatus and/or a stapling apparatus will be energized and the decision gates will be oriented so as to advance either the simplex or duplex copy sheets to the compiler tray at finishing station FF.

Figure 2:
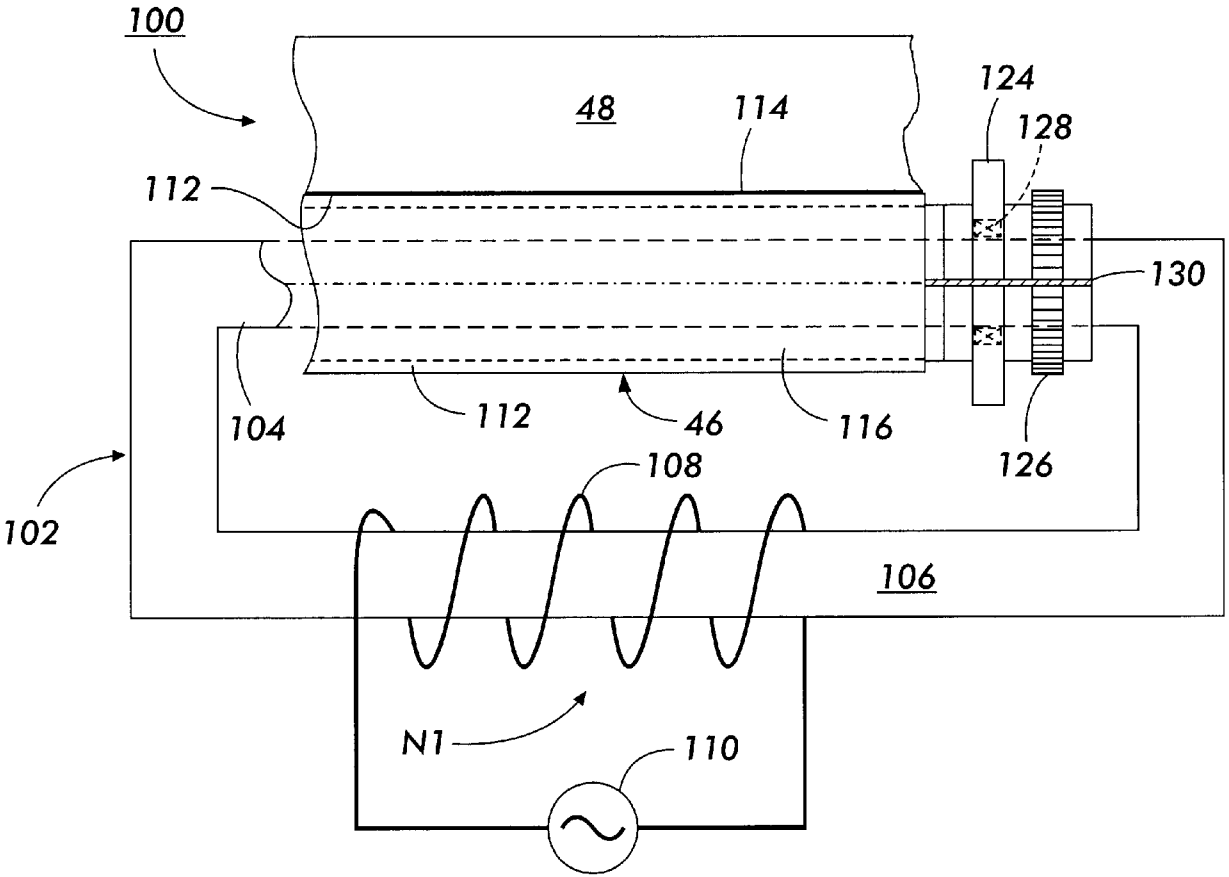
FIG. 2 is a schematic illustration of the induction heated fusing apparatus of FIG. 1.
Figure 3:
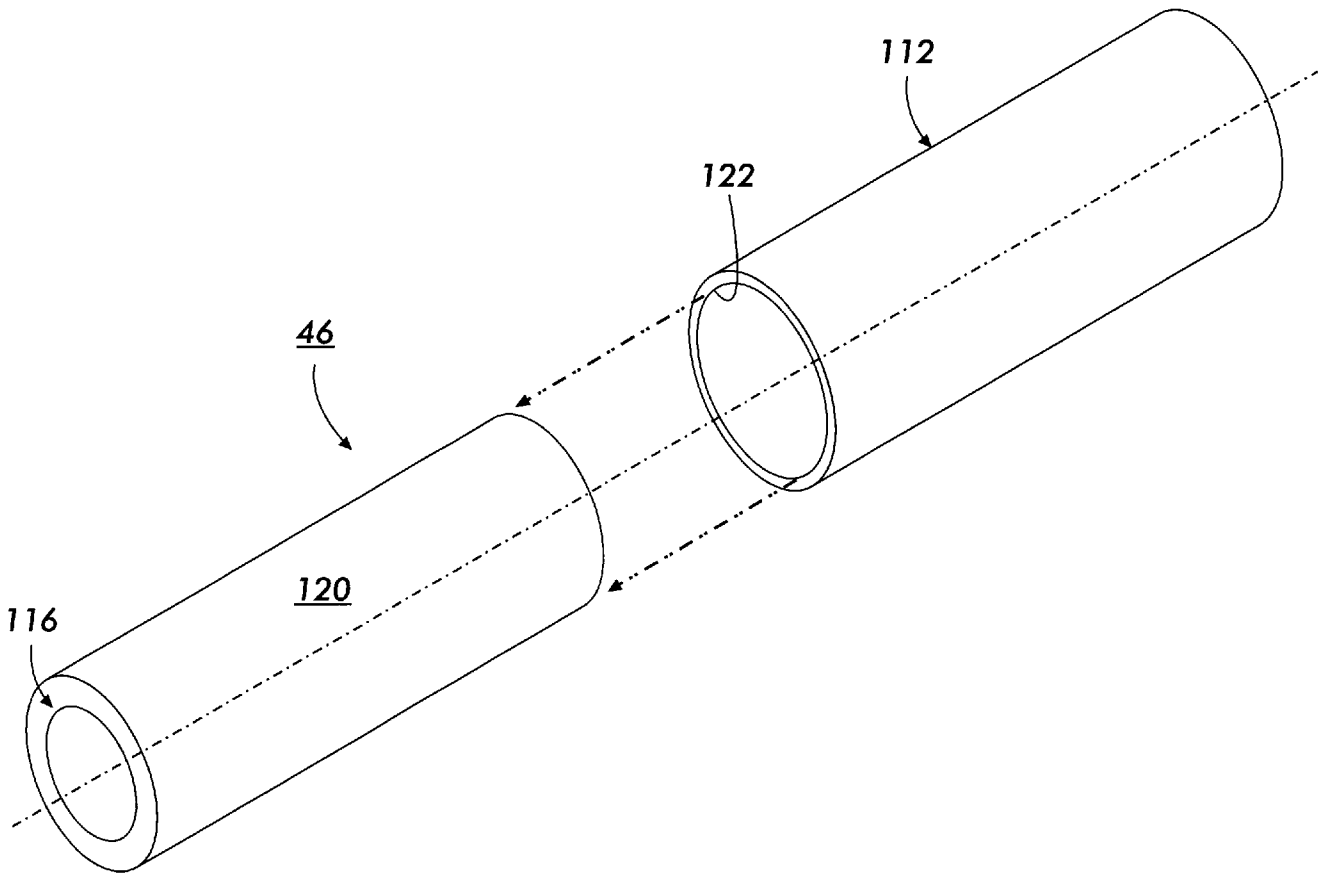
FIG. 3 is a perspective illustration of a fuser roller structure for the induction heated fusing apparatus of FIG. 2 in accordance with the present invention.

Referring now to FIGS. 1 to 3, fusing station EE includes a fuser assembly, indicated generally by the reference numeral 100, which heats and permanently affixes the transferred toner powder image to the copy sheet. As shown, the fusing apparatus 100 includes an induction heated fuser roller 46 and a back-up or pressure roller 48 with the powder image on the copy sheet contacting the fuser roller 46. The pressure roller 48 is cammed against the fuser roller 46 to provide necessary pressure for fixing the toner powder image to the copy sheet.

As further shown, the fusing apparatus 100 includes the pressure roller 48; a closed loop magnetic flux carrying member 102 positioned adjacent the pressure roller 48 and including a first side 104 and a second side 106 opposite the first side. The first side is located between the pressure roller 48 and the second side. The fusing apparatus 100 also includes an electrically conductive wire 108 wound about the second side 106 forming a primary transformer coil (108) having N1 number of turns. The primary transformer coil 108 is connectable to an AC power supply source 110 for inductively transferring AC electric energy to the first side 104. Importantly, the rotatable fuser roller 46 has an electrically conductive layer 112, at or near the surface thereof, and forms a fusing nip 114 with the pressure roller 48. The rotatable fuser roller 46 is mounted around the first side 104 of the closed loop magnetic flux carrying member 102 and forms a secondary transformer coil (112) inductively coupled to the primary transformer coil 108 for inductively receiving AC electric energy such that the conductive layer 112 thereof is inductively heated by power dissipated by the current induced therein when the primary transformer coil 108 is connected to the AC power supply source 110. When the primary transformer coil 108 is connected to the AC power supply source 110, a time varying magnetic flux is generated in the closed loop magnetic flux carrying member 102 by an AC current from the AC energy source 110, and operates to induce a voltage around a circumference of the fuser roller 46.

The fuser roller 46 preferably is mounted coaxially with the first side 104 of the closed loop magnetic flux carrying member 102. Due to induction heating, the conductive layer 112 is maintained at a much higher temperature than any other part of the fuser roller 46. The fuser roller 46 includes a rigid non-conductive core 116 underlying the conductive layer 112. The rigid non-conductive core preferably is a ceramic tube 120 (FIG. 3). The conductive layer 112 is preferably a conductive metal sleeve 122 that is shrink-fitted onto the ceramic tube 120.

The N1 number of turns of the primary transformer coil 108 are selected so as to yield a transformer turns ratio N1:1 that matches a given desired resistance of the conductive layer 112 to the characteristics of the AC power supply source 110. As further shown in FIG. 2, the fuser roller 46 includes electrically non-conductive roll end assemblies 124 including for example, a gear assembly 126, and a bearing assemblies 128, for preventing current from being induced into, and undesirably heating such roll end assemblies 124.

Specifically, in the fusing apparatus 100 including the induction heated fuser roller 46, the conductive outer layer 112 of the fuser roller is heated as a result of the $I^2R$ losses associated with the inductively induced current. This enables short warm up time for the fuser roller 46, as well as enables precise temperature control, particularly where the conductive layer or sleeve 112 has a low thermal mass, and when necessary, is insulated on the interior thereof by a thermal barrier (not shown) so as to minimize heat diffusion loss inwardly. A preferred construction for such a fuser roller (FIG. 3) is one where a thin metal sleeve 122 is fitted over a porous ceramic tube 120.

In the fusing apparatus 100, current induced into the conductive layer of sleeve 122 need be no greater than that required to keep temperature excursions to within prescribed limits as the fuser roller 46 transfers heat to an image carrying sheet being fused. In fact, the time, and power (energy) needed for the layer or sleeve 122 to reach an operating temperature is directly related to its thermal heat capacity. However, as the temperature of the layer or sleeve 122 rises, heat diffuses into the tubular or core supporting structure 120 thereby increasing the time for the layer or sleeve 122 to reach its operating temperature.

Among the many advantages of induction heating, as in the fusing apparatus 100, is the fact that the transformer turns ratio N1:1 can be used to match the resistance of the sleeve 122 to the power line (110) impedance over a wide resistivity range.

Instead of the ceramic tube 120, a thin metal tube (not shown) would also be acceptable as the support structure, provided it has a narrow slit along its length, and is electrically isolated from the outer conductive sleeve by an insulator. The slit in the tube, which is necessary to interrupt the induced current path, could be bridged with a non-conducting material in order to preserve the tube's structural strength.

Thus, in accordance with the present invention, the induction heated fuser roller 46 is an efficient, convenient heating element for applications requiring a heated roll. In the fusing apparatus 100, a metal sleeve 122 mounted coaxially with one side of a transformer core 102 having a primary transformer coil, functions as a one turn secondary winding. A time varying magnetic flux generated in the transformer core by the current through the primary transformer coil or windings induces a voltage around the circumference of the metal sleeve. This voltage produces a current in the sleeve which generates heat via $I^2R$ losses.

Another advantage of the induction heated fuser roller is that it requires no commutation, and thus can be operated at line voltage because the transformer turns ratio N1:1 can be chosen in order to match a low resistance of the heated sleeve, to the power source. Because the resistance of a metal sleeve in the circumference is generally in the micro or milli-ohm range, the induced voltage only needs to be in milli-volts in order to produce 10's of watts of heat per lineal inch in the fuser roller.

For example, consider a 1½ inch diameter inductively heated fuser roll that has a 0.0625 inch thick nickel layer or sleeve 122 as the layer to be heated. Further suppose the objective is to generate heat at a rate of 50 watts per inch. The power (P in watts) dissipated in the roll's conductive sleeve equals the square of the voltage E (volts) induced circumference wise around the sleeve divided by the resistance (ohms) of the current path around the roll's circumference. In this case, the induced voltage around the circumference will be given by:

$$E(\text{volts})=[P(pL)/A)]^{1/2}$$

Where ρ=resistivity of nickel($7.8\times10^{-6}$ Ω-cm) A=cross section of one inch section of the nickel sleeve around the circumference [sleeve thickness×I inch×(2.54 cm/inch)$^2$] L=length of current path around circumference (π×diameter cm)

Hence:

$$E=[(50\times7.8\times10^{-6}\times\pi\times1.5\times2.54)/1\times0.0625\times(2.54)^2)]^{1/2}\cong100 \text{ millivolts}$$

The 100 millivolts induced into the sleeve will produce a circumference-wise current of ≅500 amperes/lineal inch in the 1/16 inch thick nickel sleeve.

Likewise, the same voltage will be induced in any conductor that forms a close loop around the transformer core such as the roll's end assemblies 124, such as its bearings, gears, and/or brackets that mechanically support them. During induction heating of the layer or sleeve 122, extraneous heat will thus be generated in any auxiliary conductive loop that encloses the transformer core 102. Thus unless these assemblies are non-metallic, or made of a high resistivity material, they may absorb large, unwanted amounts of energy from the transformer circuit. The end hubs and yoke that support the bearings and drive gears could conceivably be made out of a high resistivity or non-conducting reinforced, high temperature plastic, but the gears and bearings required for a pressure roller are likely to be metal to provide the necessary mechanical strength.

The solution is to break up the circumference-wise conductive path in these components with a narrow slit 130 that is back-filled with a high temperature, non-conductive epoxy, or shim. For added mechanical strength, this gap may be reinforced with a non-conductive gusset plate along either side. Thus in order to avoid generating heat in the inductively heated roll's end assemblies 124, such as bearings, drive gears and their supporting brackets, it is preferred that these components be made out of either a non-conductive or high resistivity material, or made with the small slot 130 filled with insulating material, in order to open and disrupt the circuit for such extraneous current.

As can be seen, there has been provided a fusing apparatus for heating and permanently fusing toner powder images onto an image carrying sheet. The fusing apparatus includes a pressure roller; a closed loop magnetic flux carrying member positioned adjacent the pressure roller and including a first side and a second side opposite the first side. The first side is located between the pressure roller and the second side. The fusing apparatus also includes an electrically conductive wire wound about the second side forming a primary transformer coil having N1 number of turns. The primary transformer coil is connectable to an AC power supply source for inductively transferring AC electric energy to the first side. Importantly, the fusing apparatus includes a rotatable fuser roller having an electrically conductive layer forming a fusing nip with the pressure roller.

The rotatable fuser roller is mounted around the first side of the closed loop magnetic flux carrying member and forms a secondary transformer coil inductively coupled to the primary transformer coil for inductively receiving AC electric energy such that the conductive layer thereof is inductively heated by power losses from a current induced therein when the primary transformer coil is connected to the AC power supply source. The thermal time constant of the inductively heated fuser roll is minimized by using a thin conductive sleeve mounted on a low thermal conductivity support tube as the heating element. Any mechanical support elements such as end caps, bearings, gears, and yokes that enclose the transformer core are made out of high a high resistivity material or constructed with a slit that interrupts the induced current path for the purpose of minimizing or eliminating extraneous induction heating power losses.

The thermal time constant of the fuser roll can be minimized by using a thin conductive sleeve that is heat shrunk onto a support tube made out of low thermal conductivity material such as a porous ceramic. The low thermal conductivity of the support tube minimizes the rate at which heat can be diffused inwards, and the metal sleeve which is under tension can expand as is heated to its operating temperature without warping, buckling, or becoming loose.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

We claim:

1. A fusing apparatus for heating and permanently fusing toner powder images onto an image carrying sheet; the fusing apparatus comprising;

(a) a pressure roller;

(b) a closed loop magnetic flux carrying member positioned adjacent said pressure roller and including a first side and a second side opposite said first side, said first side being located between said pressure roller and said second side;

(c) an electrically conductive wire wound about said second side forming a primary transformer coil, said primary transformer coil having N1 number of turns and being connectable to an AC power supply source for inductively transferring AC electric energy to a secondary coil wound around said first side; and (d) a rotatable fuser roller forming a fusing nip with said pressure roller, said rotatable fuser roller having a rigid non-conductive core comprising a ceramic tube and a conductive metal sleeve that is shrink-fitted onto said ceramic tube for minimizing the thermal time constant of said rotatable fuser roll, said rotatable fuser roller being mounted around said first side of said closed loop magnetic flux carrying member and forming a secondary transformer coil inductively coupled to said primary transformer coil, and said conductive layer being inductively heated by power dissipated by current induced therein when said primary transformer coil is connected to said AC power supply source.

2. The fusing apparatus of claim 1, wherein a time varying magnetic flux, generated in said closed loop magnetic flux carrying member by an AC current from said AC power supply source connected to said primary transformer coil, induces a voltage around a circumference of said fuser roller.

3. The fusing apparatus of claim 1, where said N1 number of turns of said primary transformer coil are selected so as to yield a transformer turns ratio N1:1 that matches a given resistance of said conductive layer to said AC power supply source.

4. The fusing apparatus of claim 1, wherein said fuser roller as mounted is coaxial with said first side of said closed loop magnetic flux carrying member.

5. The fusing apparatus of claim 1, wherein said conductive layer when inductively heated is at a much higher temperature than any other part of said fuser roller.

* * * * *